US009533317B2

(12) United States Patent
Gehrung et al.

(10) Patent No.: US 9,533,317 B2
(45) Date of Patent: Jan. 3, 2017

(54) PAINT SPRAY GUN

(75) Inventors: Ralf Gehrung, Stuttgart (DE); Rocco Di Nicola, Leonberg (DE); Peter Dettlaff, Remseck (DE)

(73) Assignee: SATA GMBH & CO. KG, Kornwestheim (DE)

( * ) Notice: Subject to any disclaimer, the term of this patent is extended or adjusted under 35 U.S.C. 154(b) by 871 days.

(21) Appl. No.: 13/380,949

(22) PCT Filed: Jun. 7, 2010

(86) PCT No.: PCT/EP2010/003399

§ 371 (c)(1),
(2), (4) Date: Dec. 27, 2011

(87) PCT Pub. No.: WO2011/003493

PCT Pub. Date: Jan. 13, 2011

(65) Prior Publication Data

US 2012/0097762 A1 Apr. 26, 2012

(30) Foreign Application Priority Data

Jul. 8, 2009 (DE) ..... 10 2009 032 399

(51) Int. Cl.
*B05B 7/00* (2006.01)
*B05B 7/08* (2006.01)

(52) U.S. Cl.
CPC ..... *B05B 7/0815* (2013.01); *B05B 7/0838* (2013.01)

(58) Field of Classification Search
CPC ..... B05B 7/0815; B05B 7/0838; B05B 7/12; B05B 7/1209; F16K 5/04; F16K 5/0407; F16K 5/0414; F16K 5/0421; F16K 5/0442; F16K 11/085; F16K 11/0853; F16K 11/0856
(Continued)

(56) References Cited

U.S. PATENT DOCUMENTS 40,433 A 10/1863 Sees
327,260 A 9/1885 Hart
(Continued)

FOREIGN PATENT DOCUMENTS

AT 153883 6/1997
AT 163577 3/1998
(Continued)

OTHER PUBLICATIONS

English translation of International Preliminary Report on Patentability mailed Jan. 26, 2012 for PCT/EP2010/003399 filed Jun. 7, 2010.

(Continued)

*Primary Examiner* — Christopher Kim
*Assistant Examiner* — Viet Le
(74) *Attorney, Agent, or Firm* — Paul D. Bianco; Gary S. Winer; Fleit Gibbons Gutman Bongini & Bianco PL

(57) ABSTRACT

The invention relates to a paint spray gun (1) having a compressed air distribution chamber (8) into which a compressed air feed line (10), a round jet line (6) and a wide jet line (7) open, the quantity of compressed air supplied to the compressed air distribution chamber (8), the round jet line (6) and the wide jet line (7) being adjustable via a setting element arranged in the compressed air distribution chamber (8) and rotatable from outside by an actuating element (15) about an axis of rotation (D) extending through the compressed air distribution chamber (8). Said paint spray gun (1) is characterized in that the setting element is formed as a rotary distributor (14) that is held immovably in the axial direction of the axis of rotation (D) and can be rotated about the axis of rotation (D) in order to open and close openings (6', 7', 10') of the round jet line (6) and/or the wide jet line (7) and/or the compressed air feed line (10).

20 Claims, 7 Drawing Sheets

(58) Field of Classification Search
USPC ..... 239/296, 297, 291, 581.1; 251/149.9
See application file for complete search history.

(56) References Cited

U.S. PATENT DOCUMENTS

| | | | | |
|---|---|---|---|---|
| 459,432 | A | | 9/1891 | Anderson |
| 459,433 | A | | 9/1891 | Avery |
| 548,816 | A | | 10/1895 | Paul |
| 552,213 | A | | 12/1895 | Troy |
| 552,715 | A | | 1/1896 | Lugrin |
| 563,505 | A | | 7/1896 | McCornack |
| 581,107 | A | | 4/1897 | Emery |
| 644,803 | A | | 3/1900 | Justi |
| 672,012 | A | | 4/1901 | Ruper |
| 574,880 | A | | 5/1901 | Schmidt et al. |
| 1,662,496 | A | | 3/1928 | Forsgard |
| 1,703,383 | A | | 2/1929 | Birkenmaier |
| 1,703,384 | A | | 2/1929 | Birkenmaier |
| 1,711,221 | A | | 4/1929 | Blakeslee |
| 1,751,787 | A | | 3/1930 | Binks |
| 2,008,381 | A | | 7/1935 | Beeg |
| 2,049,700 | A | | 8/1936 | Gustafson |
| 2,051,210 | A | | 8/1936 | Gustafsson |
| 2,070,696 | A | | 2/1937 | Tracy |
| 2,116,036 | A | | 5/1938 | Money |
| 2,125,445 | A | | 8/1938 | Holveck |
| 2,198,441 | A | | 4/1940 | Lobegott |
| 2,204,599 | A | | 6/1940 | Jenkins |
| 2,269,057 | A | | 1/1942 | Jenkins |
| D133,223 | S | | 7/1942 | Tammen |
| 2,356,865 | A | | 8/1944 | Mason |
| 2,416,856 | A | | 3/1947 | Thomsen |
| 2,416,923 | A | | 3/1947 | Jenkins |
| 2,557,593 | A | | 6/1951 | Bjorkman |
| 2,557,606 | A | | 6/1951 | Liedberg |
| 2,559,091 | A | | 7/1951 | Reasenberg |
| 2,609,961 | A | | 9/1952 | Sapien |
| 2,612,899 | A | | 10/1952 | Webb |
| 2,646,314 | A | | 7/1953 | Peeps |
| 2,721,004 | A | | 10/1955 | Schultz |
| 2,844,267 | A | | 7/1958 | Petriccione |
| 2,886,252 | A | | 5/1959 | Ehrensperger |
| 3,090,530 | A | | 5/1963 | Peeps |
| 3,159,472 | A | | 12/1964 | Revell |
| D200,594 | S | | 3/1965 | Sass |
| 3,233,865 | A | * | 2/1966 | Panzica ..... F16K 5/04 137/625.47 |
| 3,240,398 | A | | 3/1966 | Dalton, Jr. |
| D204,306 | S | | 4/1966 | Hamm |
| D205,760 | S | | 9/1966 | Hocutt et al. |
| D208,903 | S | | 10/1967 | Zadron et al. |
| 3,344,992 | A | | 10/1967 | Norris |
| 3,381,845 | A | | 5/1968 | MacDonald |
| 3,417,650 | A | | 12/1968 | Varrin |
| 3,420,106 | A | | 1/1969 | Keller et al. |
| 3,435,683 | A | | 4/1969 | Keller et al. |
| 3,482,781 | A | | 12/1969 | Sharpe |
| D217,928 | S | | 6/1970 | Felske |
| 3,524,589 | A | | 8/1970 | Pelton, Jr. |
| 3,527,372 | A | | 9/1970 | Manning |
| 3,583,632 | A | | 6/1971 | Shaffer |
| 3,622,078 | A | | 11/1971 | Gronert |
| 3,645,562 | A | | 2/1972 | Fandetti et al. |
| 3,656,493 | A | | 4/1972 | Black et al. |
| 3,714,967 | A | | 2/1973 | Zupan et al. |
| 3,746,253 | A | | 7/1973 | Walberg |
| 3,747,850 | A | | 7/1973 | Hastings et al. |
| 3,771,539 | A | | 11/1973 | De Santis |
| 3,840,143 | A | | 10/1974 | Davis et al. |
| 3,848,807 | A | | 11/1974 | Partida |
| 3,857,511 | A | | 12/1974 | Govindan |
| 3,870,223 | A | | 3/1975 | Wyant |
| 3,873,023 | A | | 3/1975 | Moss et al. |
| 4,000,915 | A | | 1/1977 | Strom |
| D245,048 | S | | 7/1977 | Pool |
| 4,146,055 | A | * | 3/1979 | Ryder ..... F16K 11/085 137/625.41 |
| D252,097 | S | | 6/1979 | Probst et al. |
| 4,210,263 | A | | 7/1980 | Bos |
| 4,273,293 | A | | 6/1981 | Hastings |
| 4,411,387 | A | | 10/1983 | Stern et al. |
| 4,478,370 | A | | 10/1984 | Hastings |
| D276,472 | S | | 11/1984 | Harrison |
| D278,543 | S | | 4/1985 | Gintz |
| 4,545,536 | A | | 10/1985 | Avidon |
| 4,562,965 | A | | 1/1986 | Ihmels et al. |
| 4,580,035 | A | | 4/1986 | Luscher |
| 4,585,168 | A | | 4/1986 | Even et al. |
| 4,614,300 | A | | 9/1986 | Falcoff |
| 4,643,330 | A | | 2/1987 | Kennedy |
| 4,653,661 | A | | 3/1987 | Buchner et al. |
| 4,667,878 | A | | 5/1987 | Behr |
| 4,713,257 | A | | 12/1987 | Luttermoller |
| D293,950 | S | | 1/1988 | Ogden et al. |
| 4,730,753 | A | | 3/1988 | Grime |
| D298,372 | S | | 11/1988 | Taylor, Jr. |
| 4,784,184 | A | | 11/1988 | Gates |
| 4,806,736 | A | | 2/1989 | Schirico |
| 4,826,539 | A | | 5/1989 | Harpold |
| 4,832,232 | A | | 5/1989 | Broccoli |
| 4,863,781 | A | | 9/1989 | Kronzer |
| 4,877,144 | A | | 10/1989 | Thanisch |
| D305,057 | S | | 12/1989 | Morgan |
| 4,887,747 | A | | 12/1989 | Ostrowsky et al. |
| 4,901,761 | A | | 2/1990 | Taylor |
| 4,906,151 | A | | 3/1990 | Kubis |
| 4,917,300 | A | | 4/1990 | Gloviak et al. |
| 4,946,075 | A | | 8/1990 | Lundback |
| 4,964,361 | A | | 10/1990 | Aebersold |
| 4,967,600 | A | | 11/1990 | Keller |
| 4,969,603 | A | | 11/1990 | Norman |
| 4,973,184 | A | | 11/1990 | La Salle |
| D314,421 | S | | 2/1991 | Tajima et al. |
| D314,588 | S | | 2/1991 | Denham |
| 4,989,787 | A | | 2/1991 | Nikkel et al. |
| 5,020,700 | A | | 6/1991 | Krzywdziak et al. |
| D318,877 | S | | 8/1991 | Miranda et al. |
| 5,042,840 | A | | 8/1991 | Rieple et al. |
| D321,597 | S | | 11/1991 | Cerny |
| 5,064,119 | A | | 11/1991 | Mellette |
| 5,071,074 | A | | 12/1991 | Lind |
| 5,074,334 | A | * | 12/1991 | Onodera ..... 137/625.41 |
| 5,078,323 | A | | 1/1992 | Frank |
| 5,080,285 | A | | 1/1992 | Toth |
| 5,088,648 | A | | 2/1992 | Schmon |
| 5,090,623 | A | | 2/1992 | Burns et al. |
| 5,102,045 | A | | 4/1992 | Diana |
| 5,119,992 | A | | 6/1992 | Grime |
| 5,125,391 | A | | 6/1992 | Srivastava et al. |
| 5,135,124 | A | | 8/1992 | Wobser |
| 5,143,102 | A | | 9/1992 | Blaul |
| 5,165,605 | A | | 11/1992 | Morita et al. |
| 5,170,941 | A | | 12/1992 | Morita et al. |
| 5,190,219 | A | | 3/1993 | Copp, Jr. |
| 5,191,797 | A | | 3/1993 | Smith |
| 5,228,488 | A | | 7/1993 | Fletcher |
| 5,232,299 | A | | 8/1993 | Hiss |
| 5,236,128 | A | | 8/1993 | Morita et al. |
| 5,249,746 | A | | 10/1993 | Kaneko et al. |
| 5,289,974 | A | | 3/1994 | Grime et al. |
| 5,322,221 | A | | 6/1994 | Anderson |
| 5,325,473 | A | | 6/1994 | Monroe et al. |
| 5,332,156 | A | | 7/1994 | Wheeler |
| 5,333,506 | A | | 8/1994 | Smith et al. |
| 5,333,908 | A | | 8/1994 | Dorney et al. |
| 5,344,078 | A | | 9/1994 | Fritz et al. |
| 5,367,148 | A | | 11/1994 | Storch et al. |
| D353,836 | S | | 12/1994 | Carvelli et al. |
| 5,381,962 | A | | 1/1995 | Teague |
| 5,435,491 | A | | 7/1995 | Sakuma |
| 5,443,642 | A | | 8/1995 | Bienduga |
| 5,456,414 | A | | 10/1995 | Burns et al. |
| D365,952 | S | | 1/1996 | Gagnon et al. |
| 5,503,439 | A | | 4/1996 | LaJeunesse et al. |

(56) References Cited

U.S. PATENT DOCUMENTS

| | | | |
|---|---|---|---|
| 5,533,674 | A | 7/1996 | Feyrer et al. |
| 5,540,385 | A | 7/1996 | Garlick |
| 5,540,386 | A | 7/1996 | Roman |
| 5,582,350 | A | 12/1996 | Kosmyna et al. |
| 5,584,899 | A | 12/1996 | Shorts |
| 5,588,562 | A | 12/1996 | Sander et al. |
| 5,592,597 | A | 1/1997 | Kiss |
| 5,609,302 | A | 3/1997 | Smith |
| 5,613,637 | A | 3/1997 | Schmon |
| D380,301 | S | 7/1997 | Kogutt |
| 5,655,714 | A | 8/1997 | Kieffer et al. |
| 5,662,444 | A | 9/1997 | Schmidt, Jr. |
| 5,695,125 | A | 12/1997 | Kumar |
| 5,704,381 | A | 1/1998 | Millan et al. |
| 5,718,767 | A | 2/1998 | Crum et al. |
| D391,403 | S | 3/1998 | Josephs |
| RE35,769 | E | 4/1998 | Grime et al. |
| 5,762,228 | A | 6/1998 | Morgan et al. |
| 5,803,360 | A | 9/1998 | Spitznagel |
| 5,816,501 | A | 10/1998 | LoPresti et al. |
| 5,836,517 | A | 11/1998 | Burns et al. |
| D402,820 | S | 12/1998 | Morison et al. |
| 5,843,515 | A | 12/1998 | Crum et al. |
| 5,853,014 | A | 12/1998 | Rosenauer |
| D405,503 | S | 2/1999 | Endo |
| 5,874,680 | A | 2/1999 | Moore |
| 5,884,006 | A | 3/1999 | Frohlich et al. |
| D409,719 | S | 5/1999 | Kaneko |
| 5,941,461 | A | 8/1999 | Akin et al. |
| 5,951,190 | A | 9/1999 | Wilson |
| 5,951,296 | A | 9/1999 | Klein |
| 5,954,268 | A | 9/1999 | Joshi et al. |
| D414,636 | S | 10/1999 | Wiese |
| 5,979,797 | A | 11/1999 | Castellano |
| 5,992,763 | A | 11/1999 | Smith et al. |
| 6,006,930 | A | 12/1999 | Dreyer et al. |
| 6,010,082 | A | 1/2000 | Peterson |
| 6,017,394 | A | 1/2000 | Crum et al. |
| 6,036,109 | A | 3/2000 | DeYoung |
| 6,039,218 | A | 3/2000 | Beck |
| 6,053,429 | A | 4/2000 | Chang |
| 6,056,213 | A | 5/2000 | Ruta et al. |
| 6,089,471 | A | 7/2000 | Scholl |
| 6,089,607 | A | 7/2000 | Keeney et al. |
| 6,091,053 | A | 7/2000 | Aonuma |
| 6,092,740 | A | 7/2000 | Liu |
| 6,132,511 | A | 10/2000 | Crum et al. |
| D435,379 | S | 12/2000 | Nguyen |
| 6,250,567 | B1 | 6/2001 | Lewis et al. |
| 6,276,616 | B1 | 8/2001 | Jenkins |
| D448,451 | S | 9/2001 | Turnbull et al. |
| 6,308,991 | B1 | 10/2001 | Royer |
| D457,599 | S | 5/2002 | Karwoski et al. |
| D459,432 | S | 6/2002 | Schmon |
| D459,433 | S | 6/2002 | Schmon |
| 6,402,058 | B2 | 6/2002 | Kaneko et al. |
| 6,402,062 | B1 | 6/2002 | Bending et al. |
| 6,431,466 | B1 | 8/2002 | Kitajima |
| 6,435,426 | B1 | 8/2002 | Copp, Jr. |
| 6,442,276 | B1 | 8/2002 | Doljack |
| 6,494,387 | B1 | 12/2002 | Kaneko |
| 6,536,684 | B1 | 3/2003 | Wei |
| 6,536,687 | B1 | 3/2003 | Navis et al. |
| D472,730 | S | 4/2003 | Sparkowski |
| 6,540,114 | B1 | 4/2003 | Popovich et al. |
| 6,543,632 | B1 | 4/2003 | McIntyre et al. |
| 6,547,884 | B1 | 4/2003 | Crum et al. |
| 6,553,712 | B1 | 4/2003 | Majerowski et al. |
| 6,554,009 | B1 | 4/2003 | Beijbom et al. |
| D474,528 | S | 5/2003 | Huang |
| 6,585,173 | B2 | 7/2003 | Schmon et al. |
| 6,595,441 | B2 | 7/2003 | Petrie et al. |
| 6,626,382 | B1 | 9/2003 | Liu |
| 6,626,383 | B1 | 9/2003 | Campbell |
| 6,647,997 | B2 | 11/2003 | Mohn |
| 6,661,438 | B1 | 12/2003 | Shiraishi et al. |
| D485,685 | S | 1/2004 | Zupkofska et al. |
| 6,675,845 | B2 | 1/2004 | Volpenheim et al. |
| 6,692,118 | B2 | 2/2004 | Michele et al. |
| 6,712,292 | B1 | 3/2004 | Gosis et al. |
| 6,717,584 | B2 | 4/2004 | Kulczycka |
| 6,732,751 | B2 | 5/2004 | Chiang |
| 6,763,964 | B1 | 7/2004 | Hurlbut et al. |
| 6,766,763 | B2 | 7/2004 | Crum et al. |
| 6,786,345 | B2 | 9/2004 | Richards |
| 6,796,514 | B1 | 9/2004 | Schwartz |
| 6,801,211 | B2 | 10/2004 | Forsline et al. |
| 6,820,824 | B1 | 11/2004 | Joseph et al. |
| 6,843,390 | B1 | 1/2005 | Bristor |
| 6,845,924 | B2 | 1/2005 | Schmon |
| 6,855,173 | B2 | 2/2005 | Ehrnsperger et al. |
| 6,863,310 | B1 | 3/2005 | Petkovsek |
| 6,863,920 | B2 | 3/2005 | Crum et al. |
| 6,874,656 | B2 | 4/2005 | Rohr et al. |
| 6,874,664 | B1 | 4/2005 | Montgomery |
| 6,874,708 | B2 | 4/2005 | Reetz, III |
| 6,877,677 | B2 | 4/2005 | Schmon et al. |
| 6,929,019 | B2 | 8/2005 | Weinmann et al. |
| 6,945,429 | B2 | 9/2005 | Gosis et al. |
| 6,955,180 | B2 | 10/2005 | Kocherlakota et al. |
| 6,962,432 | B2 | 11/2005 | Hofeldt |
| 6,963,331 | B1 | 11/2005 | Kobayashi et al. |
| 7,017,838 | B2 | 3/2006 | Schmon |
| 7,018,154 | B2 | 3/2006 | Schmon |
| D519,687 | S | 4/2006 | Zahav |
| 7,036,752 | B1 | 5/2006 | Hsiang |
| 7,083,119 | B2 | 8/2006 | Bouic et al. |
| 7,090,148 | B2 | 8/2006 | Petrie et al. |
| 7,097,118 | B1 | 8/2006 | Huang |
| D528,192 | S | 9/2006 | Nicholson |
| 7,106,343 | B1 | 9/2006 | Hickman |
| 7,165,732 | B2 | 1/2007 | Kosmyna et al. |
| 7,172,139 | B2 | 2/2007 | Bouic et al. |
| 7,175,110 | B2 | 2/2007 | Vicentini |
| 7,182,213 | B2 | 2/2007 | King |
| D538,050 | S | 3/2007 | Tardif |
| D538,493 | S | 3/2007 | Zimmerle et al. |
| D538,886 | S | 3/2007 | Huang |
| 7,194,829 | B2 | 3/2007 | Boire et al. |
| D541,053 | S | 4/2007 | Sanders |
| D541,088 | S | 4/2007 | Nesci |
| 7,201,336 | B2 | 4/2007 | Blette et al. |
| 7,216,813 | B2 | 5/2007 | Rogers |
| D545,943 | S | 7/2007 | Rodgers et al. |
| 7,246,713 | B2 | 7/2007 | King |
| 7,249,519 | B2 | 7/2007 | Rogers |
| D548,816 | S | 8/2007 | Schmon |
| 7,255,293 | B2 | 8/2007 | Dodd |
| 7,264,131 | B2 | 9/2007 | Tsutsumi et al. |
| D552,213 | S | 10/2007 | Schmon |
| D552,715 | S | 10/2007 | Schmon |
| D554,703 | S | 11/2007 | Josephson |
| D563,505 | S | 3/2008 | Schmon |
| 7,374,111 | B2 | 5/2008 | Joseph et al. |
| D571,463 | S | 6/2008 | Chesnin |
| 7,384,004 | B2 | 6/2008 | Rogers |
| RE40,433 | E | 7/2008 | Schmon |
| D573,227 | S | 7/2008 | Mirazita et al. |
| D574,926 | S | 8/2008 | Huang |
| D575,374 | S | 8/2008 | Huang |
| 7,410,106 | B2 | 8/2008 | Escoto, Jr. et al. |
| 7,416,140 | B2 | 8/2008 | Camilleri et al. |
| 7,422,164 | B2 | 9/2008 | Matsumoto |
| D579,213 | S | 10/2008 | Aipa |
| D581,107 | S | 11/2008 | Schmon |
| D581,483 | S | 11/2008 | Bass et al. |
| D583,013 | S | 12/2008 | Wang |
| 7,458,612 | B1 | 12/2008 | Bennett |
| 7,533,678 | B2 | 5/2009 | Rosa |
| 7,540,434 | B2 | 6/2009 | Gohring et al. |
| 7,542,032 | B2 | 6/2009 | Kruse |
| 7,568,638 | B2 | 8/2009 | Gehrung |
| D604,394 | S | 11/2009 | Wang |
| 7,614,571 | B2 | 11/2009 | Camilleri et al. |

(56) References Cited

U.S. PATENT DOCUMENTS

D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,893 B2 4/2010 Zittel et al.
7,694,896 B2 4/2010 Turnbull et al.
D615,586 S 5/2010 Kudimi
D616,022 S 5/2010 Kudimi
D616,527 S 5/2010 Anderson et al.
7,765,876 B1 8/2010 Chen
D624,668 S 9/2010 Noppe
7,810,744 B2 10/2010 Schmon et al.
7,819,341 B2 10/2010 Schmon et al.
D627,039 S 11/2010 Yu
D627,432 S 11/2010 Escoto et al.
7,823,806 B2 11/2010 Schmon
D629,623 S 12/2010 Lampe
7,913,938 B2 3/2011 Cooper
7,922,107 B2 4/2011 Fox
D637,269 S 5/2011 Wang
D638,121 S 5/2011 Villasana
D639,863 S 6/2011 Langan
D641,067 S 7/2011 Wang
D644,716 S 9/2011 Gehrung
D644,803 S 9/2011 Schmon
D645,094 S 9/2011 Langan
8,042,402 B2 10/2011 Brown et al.
D649,196 S 11/2011 Langan
8,052,071 B2 11/2011 Kruse
D655,347 S 3/2012 Gehrung
8,127,963 B2 3/2012 Gerson et al.
D657,276 S 4/2012 Brose
D661,742 S 6/2012 Clark
D663,960 S 7/2012 Jeronimo
8,225,892 B2 7/2012 Ben-Tzvi
8,240,579 B1 8/2012 Bennett
8,297,536 B2 10/2012 Ruda
D670,085 S 11/2012 Brookman et al.
D671,988 S 12/2012 Leipold
D672,012 S 12/2012 Brose et al.
D674,880 S 1/2013 Schmon
8,352,744 B2 1/2013 Kruse
D681,162 S 4/2013 Kruse
8,444,067 B2 5/2013 Schmon et al.
8,454,759 B2 6/2013 Selsvik
8,481,124 B2 7/2013 Nolte et al.
D689,590 S 9/2013 Brose
D689,593 S 9/2013 Schmon
D690,799 S 10/2013 Maier
D692,530 S 10/2013 Gehrung
D692,532 S 10/2013 Li et al.
8,616,434 B2 12/2013 Wilen
D698,008 S 1/2014 Schmon et al.
8,626,674 B2 1/2014 Whitehouse
8,642,131 B2 2/2014 Nolte et al.
D704,300 S 5/2014 Li et al.
8,757,182 B2 6/2014 Schmon
8,807,460 B2 8/2014 Charpie et al.
8,857,732 B2 10/2014 Brose
D720,015 S 12/2014 Kruse
8,899,501 B2 12/2014 Fox et al.
D721,785 S 1/2015 Gehrung
8,925,836 B2 1/2015 Dettlaff
D733,369 S 6/2015 Tschan
D733,453 S 7/2015 Tschan
D734,571 S 7/2015 Tschan
9,073,068 B2 7/2015 Krayer et al.
D737,126 S 8/2015 Tschan
D740,393 S 10/2015 Gehrung
2001/0004996 A1 6/2001 Schmon
2001/0040192 A1 11/2001 Kaneko et al.
2002/0134861 A1 9/2002 Petrie et al.
2002/0148501 A1* 10/2002 Shieh ..... 137/119.04
2002/0170978 A1 11/2002 Mohn
2003/0025000 A1 2/2003 Schmon et al.
2003/0066218 A1 4/2003 Schweikert
2003/0121476 A1 7/2003 McIntyre et al.
2003/0127046 A1 7/2003 Zehner et al.
2003/0164408 A1 9/2003 Schmon
2003/0177979 A1 9/2003 Crum et al.
2003/0189105 A1 10/2003 Schmon
2003/0209568 A1 11/2003 Douglas et al.
2003/0213857 A1 11/2003 Schmon et al.
2003/0218596 A1 11/2003 Eschler
2003/0230636 A1 12/2003 Rogers
2004/0046051 A1 3/2004 Santa Cruz et al.
2004/0050432 A1* 3/2004 Breda ..... 137/625.11
2004/0104194 A1 6/2004 Dennison
2004/0129738 A1 7/2004 Stukas
2004/0140373 A1 7/2004 Joseph et al.
2004/0154671 A1* 8/2004 Martins ..... B60H 1/00485 137/625.47
2004/0155063 A1 8/2004 Hofeldt
2004/0177890 A1 9/2004 Weinmann
2004/0191406 A1 9/2004 Crum et al.
2004/0217201 A1 11/2004 Ruda
2004/0233223 A1 11/2004 Schkolne et al.
2004/0245208 A1 12/2004 Dennison
2005/0056613 A1 3/2005 King
2005/0082249 A1 4/2005 King
2005/0127201 A1 6/2005 Matsumoto
2005/0145723 A1 7/2005 Blette et al.
2005/0145724 A1 7/2005 Blette et al.
2005/0178854 A1 8/2005 Dodd
2005/0220943 A1 10/2005 Abrams et al.
2005/0248148 A1 11/2005 Schenck et al.
2005/0252993 A1 11/2005 Rogers
2005/0252994 A1 11/2005 Rogers
2005/0268949 A1 12/2005 Rosa
2005/0284963 A1 12/2005 Reedy
2006/0000927 A1 1/2006 Ruda
2006/0007123 A1 1/2006 Wilson et al.
2006/0048803 A1 3/2006 Jessup et al.
2006/0081060 A1 4/2006 Forster
2006/0096644 A1* 5/2006 Goldfarb ..... F16K 11/085 137/625.47
2006/0113409 A1 6/2006 Camilleri et al.
2006/0171771 A1 8/2006 Kruse
2006/0192377 A1 8/2006 Bauer et al.
2006/0196891 A1 9/2006 Gerson et al.
2007/0029788 A1 2/2007 Adler
2007/0055883 A1 3/2007 Kruse
2007/0102540 A1* 5/2007 MacLean-Blevins .... B05B 7/12 239/310
2007/0131795 A1 6/2007 Abbate et al.
2007/0144953 A1* 6/2007 Rivi ..... F16K 11/085 210/130
2007/0158349 A1 7/2007 Schmon et al.
2007/0205305 A1 9/2007 Vagedes
2007/0221754 A1 9/2007 Gehrung
2007/0252378 A1 11/2007 Chambers
2008/0011879 A1 1/2008 Gerson et al.
2008/0019789 A1 1/2008 Dunaway et al.
2008/0029619 A1 2/2008 Gohring et al.
2008/0041471 A1* 2/2008 Paterson ..... F16K 5/0407 137/625.47
2008/0128533 A1 6/2008 Gehrung
2008/0179763 A1 7/2008 Schmon et al.
2008/0251977 A1 10/2008 Naruse et al.
2008/0264892 A1 10/2008 Nozawa
2008/0272213 A1 11/2008 Ting
2008/0296410 A1 12/2008 Carey et al.
2009/0014557 A1 1/2009 Schmon et al.
2009/0026290 A1 1/2009 Fox
2009/0045623 A1 2/2009 Schmon
2009/0072050 A1 3/2009 Ruda
2009/0078789 A1 3/2009 Kruse
2009/0078790 A1 3/2009 Camilleri et al.
2009/0143745 A1 6/2009 Langan et al.
2009/0183516 A1 7/2009 Appler et al.
2009/0235864 A1 9/2009 Khoury et al.
2009/0266915 A1 10/2009 Fedorov
2010/0021646 A1 1/2010 Nolte et al.

(56) References Cited

U.S. PATENT DOCUMENTS

| | | | | |
|---|---|---|---|---|
| 2010/0059533 | A1 | 3/2010 | Unger et al. | |
| 2010/0084493 | A1 | 4/2010 | Troudt | |
| 2010/0108783 | A1 | 5/2010 | Joseph et al. | |
| 2010/0126541 | A1 | 5/2010 | Schmon | |
| 2010/0206963 | A1 | 8/2010 | Huang | |
| 2010/0305508 | A1* | 12/2010 | Franks | A61M 5/14216 604/152 |
| 2011/0024524 | A1 | 2/2011 | Fox | |
| 2011/0121103 | A1 | 5/2011 | Carleton et al. | |
| 2011/0125607 | A1 | 5/2011 | Wilen | |
| 2011/0127767 | A1 | 6/2011 | Wicks et al. | |
| 2011/0168811 | A1 | 7/2011 | Fox et al. | |
| 2011/0174901 | A1 | 7/2011 | Dettlaff et al. | |
| 2012/0012671 | A1 | 1/2012 | Brose et al. | |
| 2012/0097762 | A1 | 4/2012 | Gehrung et al. | |
| 2012/0132550 | A1 | 5/2012 | Gerson et al. | |
| 2012/0160935 | A1 | 6/2012 | Krayer et al. | |
| 2013/0056556 | A1 | 3/2013 | Schmon et al. | |
| 2013/0074864 | A1 | 3/2013 | Nuzzo et al. | |
| 2013/0266734 | A1 | 10/2013 | Nolte et al. | |
| 2013/0320110 | A1 | 12/2013 | Brose et al. | |
| 2014/0048627 | A1 | 2/2014 | Schmon et al. | |
| 2014/0059905 | A1 | 3/2014 | Raming | |
| 2014/0145003 | A1 | 5/2014 | Schmon et al. | |
| 2014/0305962 | A1 | 10/2014 | Tschan | |
| 2015/0165463 | A1 | 6/2015 | Gehrung | |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CH | 203 668 | | 6/1939 |
| CH | 542104 | A | 9/1973 |
| CH | 676208 | | 12/1990 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102211069 | | 10/2011 |
| DE | 460381 | | 5/1928 |
| DE | 1425890 | | 11/1968 |
| DE | 2950341 | | 7/1980 |
| DE | 3016419 | | 11/1981 |
| DE | 8024829.9 | | 9/1982 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | 4321940 | | 1/1995 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 102 05 831 | | 8/2003 |
| DE | 03069208 | A1 | 8/2003 |
| DE | 10205831 | | 8/2003 |
| DE | 10311238 | | 10/2004 |
| DE | 10 2004 027 789 | | 2/2005 |
| DE | 10 2004 027789 | | 2/2005 |
| DE | 29825120 | | 2/2005 |
| DE | 2004027789 | A1 | 2/2005 |
| DE | 20320781 | | 6/2005 |
| DE | 10 2004 014 646 | | 7/2005 |
| DE | 10 2004 003 438 | | 8/2005 |
| DE | 102004003439 | | 8/2005 |
| DE | 10 2004 007 733 | | 9/2005 |
| DE | 10 2004 021 298 | | 11/2005 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007039106 | | 2/2009 |
| DE | 102007052067 | | 5/2009 |
| DE | 202010012449 | | 12/2010 |
| DE | 102009053449 | | 2/2011 |
| DE | 102010060086 | | 4/2012 |
| DE | 102011106060 | | 1/2013 |
| DE | 102011118120 | | 5/2013 |
| EP | 0092392 | | 10/1983 |
| EP | 524408 | | 1/1993 |
| EP | 567325 | | 10/1993 |
| EP | 0631821 | | 1/1995 |
| EP | 0650766 | | 5/1995 |
| EP | 678334 | | 10/1995 |
| EP | 0706832 | | 4/1996 |
| EP | 0706832 | A1 | 4/1996 |
| EP | 0710506 | | 5/1996 |
| EP | 801002 | | 10/1997 |
| EP | 987060 | | 3/2000 |
| EP | 1081639 | | 3/2001 |
| EP | 1106262 | | 6/2001 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |

(56) References Cited

FOREIGN PATENT DOCUMENTS

| | | | |
|---|---|---|---|
| EP | 1504823 | A1 | 2/2005 |
| EP | 1563913 | | 8/2005 |
| EP | 1574262 | | 9/2005 |
| EP | 1602412 | | 12/2005 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 2027931 | | 2/2009 |
| EP | 2106298 | | 10/2009 |
| EP | 2111920 | | 10/2009 |
| EP | 2490819 | | 8/2012 |
| EP | 2576079 | | 4/2013 |
| EP | 2608890 | | 7/2013 |
| FR | 398333 | | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2927824 | A1 | 8/2009 |
| GB | 190900523 | | 6/1909 |
| GB | 2 132 916 | | 7/1984 |
| GB | 2153260 | | 8/1985 |
| GB | 2372465 | | 8/2002 |
| GB | 2411235 | | 8/2005 |
| HK | 1100405 | | 6/2009 |
| HK | 1096057 | | 7/2009 |
| HK | 1125067 | | 8/2012 |
| HK | 1138533 | | 11/2012 |
| JP | S5654328 | | 5/1981 |
| JP | S57-75246 | | 5/1982 |
| JP | 58-119862 | | 5/1983 |
| JP | S5998757 | | 6/1984 |
| JP | S601722 | | 1/1985 |
| JP | H01-87805 | | 6/1989 |
| JP | H0530749 | | 4/1993 |
| JP | H05172678 | | 7/1993 |
| JP | 674850 | | 3/1994 |
| JP | H06215741 | | 8/1994 |
| JP | H08196950 | | 8/1996 |
| JP | H09117697 | | 5/1997 |
| JP | 2001259487 | | 9/2001 |
| JP | 2003042882 | | 2/2002 |
| JP | 2003088780 | | 3/2003 |
| JP | 2004017044 | | 1/2004 |
| JP | 2005138885 | | 6/2005 |
| JP | 2007516831 | | 6/2007 |
| TW | 491092 | | 6/2002 |
| TW | I220392 | | 8/2004 |
| TW | I303587 | | 12/2008 |
| TW | I309584 | | 5/2009 |
| WO | 90/08456 | | 8/1990 |
| WO | 91/16610 | | 10/1991 |
| WO | 92/07346 | | 4/1992 |
| WO | 9522409 | | 8/1995 |
| WO | 98/32539 | | 7/1998 |
| WO | 01/12337 | | 2/2001 |
| WO | 0166261 | | 9/2001 |
| WO | 01/99062 | | 12/2001 |
| WO | 02/00355 | | 1/2002 |
| WO | 0202242 | | 1/2002 |
| WO | 02/18061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 2004/037433 | | 5/2004 |
| WO | 2004/052552 | | 6/2004 |
| WO | 2005/018815 | | 3/2005 |
| WO | 2005/068220 | | 7/2005 |
| WO | 2005/070557 | | 8/2005 |
| WO | 2005/070558 | | 8/2005 |
| WO | 2005/077543 | | 8/2005 |
| WO | 2005/115631 | | 12/2005 |
| WO | 2006065850 | | 6/2006 |
| WO | 2007/128127 | | 11/2007 |
| WO | 2007133386 | A2 | 11/2007 |
| WO | 2007/149760 | A2 | 12/2007 |
| WO | 2009015260 | | 1/2009 |
| WO | 2009056424 | | 5/2009 |
| WO | 2011047876 | | 4/2011 |
| WO | 2011147555 | | 12/2011 |
| WO | 2012119664 | | 9/2012 |
| WO | 2013000524 | | 1/2013 |
| WO | 2013016474 | | 1/2013 |

OTHER PUBLICATIONS

German International Search Report published Jan. 13, 2011 for PCT/EP2010/003399 filed Jun. 7, 2010.

English translation of International Search Report published Jan. 13, 2011 for PCT/EP2010/003399 filed Jun. 7, 2010.

Office Action dated Nov. 18, 2014 for U.S. Appl. No. 14/113,649.

Notice of Allowance dated Nov. 19, 2014 for U.S. Appl. No. 29/486,223.

Final Office Action dated Jul. 20, 2015 for U.S. Appl. No. 14/113,649.

Restriction Requirement dated Jan. 9, 2015 for Design U.S. Appl. No. 29/469,049.

Response to Office Action filed Dec. 2, 2014 for U.S. Appl. No. 29/487,679.

Notice of Allowance dated Jan. 15, 2015 for Design U.S. Appl. No. 29/490,620.

Office Action dated Jan. 14, 2015 for Design U.S. Appl. No. 29/447,887.

Hercules Paint Gun Washers brochure publish date Jan 2012, [online], [site visited Jan. 7, 2015], <http://www.herkules.us/pdfs/L00761-Hercules-Gun_Washers-4-page-brochure.pdf>.

Jetclean GUn Cleaner Terry's Auto Supply, google publish date Aug. 4, 2011, [online], [site visited Jan. 7, 2015], <http://secure.terrys.net/viewProduct.php?productID=FT.FHAZ1005>.

Restriction Requirement dated Feb. 6, 2015 for Design U.S. Appl. No. 29/486,232.

Office Action dated Mar. 30, 2015 for U.S. Appl. No. 13/698,417.

Responde to Office Action filed Apr. 14, 2015 to Office Action dated Jan. 14, 2015 for U.S. Appl. No. 29/447,887.

Response filed Jul. 20, 2015 for Office Action dated Mar. 30, 2015 for U.S. Appl. No. 13/698,417.

Notice of Allowance dated Apr. 30, 2015 for U.S. Appl. No. 29/447,887.

Chinese Office Action dated Oct. 28, 2014 and Search Report dared Oct. 15, 2014 for Chinese Application No. 2011800266029.

Australian Examination Report dated Oct. 30, 2012 for Australian Application No. 2010268870.

Notice of Allowance dated Apr. 24, 2015 for Design U.S. Appl. No. 29/486,232.

Restriction Requirement dated Jan. 22, 2015 for U.S. Appl. No. 13/698,417.

Response filed Mar. 23, 2015 to Restriction Requirement dated Jan. 22, 2015 for U.S. Appl. No. 13/698,417.

Response filed Apr. 6, 2015 to Office Action dated Feb. 6, 2015 for Design U.S. Appl. No. 29/486,232.

Application filed Mar. 3, 2015, 2015 for Design U.S. Appl. No. 29/519,198.

Japanese Office Action dated Jun. 11, 2014 for Japanese Patent Application No. 2012-518769.

Australian Examination Report dated Nov. 11, 2014 for Australian patent Application No. 2011257605.

Japanese Notice of Allowance mailed Jan. 13, 2015 for Japanese Patent Application No. 2012/518769.

(56) References Cited

OTHER PUBLICATIONS

Application filed Jan. 29, 2015 for Design U.S. Appl. No. 29/516,082.
Chinese Office Action dated Jan. 28, 2014 and Search Report dated Jan. 21, 2014 for Chinese Application No. 201080030935.4.
German Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25, 2014 for German Application No. 202013105779-7.
Application filed Nov. 16, 2012 for U.S. Appl. No. 13/698,417.
Application filed Jun. 2, 2013 for U.S. Appl. No. 13/991,285.
English translation of application filed Aug. 13, 2013 for Application filed Jun. 2, 2013 for U.S. Appl. No. 13/991,285 (26).
Restriction Requirement dated May 27, 2015 for U.S. Appl. No. 13/991,285.
Application filed Jan. 29, 2015 for Design U.S. Appl. No. 29/516,073.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued agains JP Patent App. 2012-508926 on Feb. 25, 2014 with English translation.
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
Response filed Oct. 6, 2015 to Notice of Non-Compliant Amendment for U.S. Appl. No. 13/698,417.
Notice of Non-Compliant Amendment dated Aug. 10, 2015 for U.S. Appl. No. 13/698,417.
Final Office Action dated Oct. 16, 2015 for U.S. Appl. No. 13/698,417.
Extended European Search Report dated Apr. 17, 2015 for European Application No. 14004167.4.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Notice of Allowance dated Aug. 3, 2015 for U.S Appl. No. 29/486,232 (69).
Response filed Dec. 21, 2015 to Office Action dated Jul. 20, 2015 for U.S. Appl. No. 14/113,649.
Printout from Internet www.ehow.com explaining how to choose a spray gun and stating in item 2 "Nozzle sizes vary between about 1 mm and 2 mm.", printed Sep. 7, 2012.
Printout from Internet www.bodyshopbusiness.com explaining how to choose nozzle setup in paragraph bridging pp. 1 and 2, giving general rule of thumb of nozzle sizes from 13 mm to 2.2 mm, depending on material being sprayed, printed Sep. 7, 2012.
Printout from Internet of pages from brochure of Walther Pilot showing nozzle sizes for spray guns ranging from 0.3 mm to 2.5 mm, dated 2007.
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012.
Printout from Internet p. 28 from current 3Mtm brochure showing Tip/Nozzle/Air Cap Selection Guide with nozzle sizes from 0.5 mm to 3.0 mm.
Decision by EPO regarding opposition proceedings to revoke patent No. 99926841.0-2425/ 1108476, aorresponding to '387 patent, 2012.
SATA News Publication Dan-Am Jul.-Sep. 1996.
SATA News Publication Dan-Am Oct.-Dec. 1996.
SATA News Publication Dan-Am Apr.-Jun. 1998.
Dan-Am SATA Catalog 6 for spray guns 1991.
Dan-Am SATA Catalog 8 for spray guns 1994.
Dan-Am Catalog 6-51pp published 1991.
Japanese Industrial Standards B 9809 English translation, 1992.
Japanese Industrial Standards B 9809 revised Mar. 1, 1991.
SATA News, vol. 21, 2009.
Collision Hub TV Document (image from video clip) printed Oct. 9, 2013.
MyRielsMe.com document from press release printed Oct. 9, 2013.
How to set Air pressure, Utube screenshot printed Oct. 9, 2013.
Ohio EPA Letty to Tony Larimer, response to letter dated Aug. 2006.
Pinahs Ben-Tzvi et al, A conceptual design . . . , Mechatrronics 17 (2007) p. 1-13.
On line ad from Amazon.com printed Oct. 14, 2013.
Rone et al, MEMS-Baed Microdroplet Generation with Integrated Sensing, COMSOL, 2011.
Office Action dated Aug. 7, 2015 for U.S. Appl. No. 13/991,285.
Notice of Allowance dated Jan. 27, 2016 for Design U.S. Appl. No. 29/510,723.
Office Action dated Dec. 31, 2015 for U.S. Appl. No. 14/572,998.
Notice of Allowance dated Jan. 19, 2016 for Design U.S. Appl. No. 29/539,615.
Notice of Allowance dated Jan. 22, 2016 for U.S. Appl. No. 13/991,285.

* cited by examiner

A–A
B–B
C–C
a)
b)
c)
d)
e)
A
B
C
D
1
6
6'
7
7'
8
8b
8c
10
10'
13
14
15
16
18
19
20
21
22
23
24
146a
146b
147
147a

A–A
B–B
C–C
a)
b)
c)
d)
e)
1
6
6'
7
7'
8b
10
10'
13
14
15
16
18
19
20
21
22
23
24
146a
147a

PAINT SPRAY GUN

FIELD OF THE INVENTION

The invention relates to a paint spray gun and an associated compressed air distribution insert.

BACKGROUND OF THE INVENTION

The generic paint spray gun is known from EP 0 706 832 B1. Said paint spray gun presents a compressed air distributor which is connected to a compressed air feed line, and which distributes the compressed air of the compressed air feed line over a horn air supply line and a round jet supply line. The compressed air quantity fed to the horn air supply line can be set by screw adjustment of a plug, which presents a terminal sealing spigot for continuous opening or closing of the horn air supply line. To delimit the pressure that is generated in the round jet area to a maximum, if at the time of the closing of the horn air the pressure in the round jet area increases above the maximum admissible for paint spray guns, the plug presents, seen from its end, an area of larger diameter, in the direction towards the sealing spigot, which also continuously narrows the air pathway between the compressed air feed line and round jet supply line, at the time of the closing of the horn air supply line. The plug is shifted there by means of a knurled knob rotating in the axial direction. The solution described therein presents the disadvantage that, owing to the axial resetting kinematics of the plug for opening or closing the lines in the compressed air distributor, the knurled knob needs to be turned one rotation. Moreover, the design of the plug with the sealing spigots and the plate-like disk makes it impossible to determine or calculate with precision the distribution of air in the compressed air distributor. In addition, the multipart design is disadvantageous here from the point of view of manufacturing technology. Moreover, during the adjustment, the distance between the knurled knob and the gun body changes, which is often perceived as disadvantageous.

SUMMARY OF THE INVENTION

The invention is consequently based on the problem of providing a paint spray gun and a compressed air distributor that overcome the above-mentioned disadvantages, and that allow a setting of the pressure, which is simple to perform, as well as an easily calculated compressed air distribution in the paint spray gun.

Advantageous embodiments and preferred embodiments of the invention can be taken from the claims.

This problem is solved by a paint spray gun having the characteristics of Claim 1, as well as by a compressed air distribution insert having the characteristics of Claim 18. Advantageous embodiments and preferred embodiments of the invention can be taken from the dependent claims.

A paint spray gun mentioned in the introduction is characterized according to the invention by the fact that the setting element is designed as a rotary distributor for opening and closing the openings of the round jet line and the wide jet line, which is immovable in the axial direction of the axis of rotation in the rotary distributor, which is held in the compressed-air distribution chamber, and which can be rotated about the axis of rotation. Due to this exclusive adjustment kinematics of the rotary distributor, the clearly smaller adjustment angle from completely closed to completely wide jet opening kinematics is made possible here. In the solution according to EP 0 706 832 B1, the adjustment angle, on the other hand, is approximately 410°; in this case, the knurling knob therefore has to be turned from the opened to the closed horn air opening by more than one full rotation. This prevents, among other factors, a simple display of the current opening position indicator of the horn air opening. Moreover, the design of the rotary distributor, and thus the setting of the correct ratio of the different openings in the compressed air distribution chamber relative to each other can be simulated, calculated, or determined empirically, in a simple way. An additional advantage is that the handle for the rotary distributor is always at the same distance from the paint spray gun.

In a preferred embodiment of the invention, the compressed air distribution chamber is designed as a compressed air distribution cylinder having an opening, and walls formed by the bottom and a lateral surface, wherein the rotary distributor presents, at its end turned away from and/or facing the rotary handle, a guide that is applied to the lateral surface. As a result, a simple design can be achieved that at the same time provides good guidance of the rotary distributor in the compressed air distribution cylinder. In a manner that is advantageous for the manufacturing technology, the guide can be a circular disk and/or a circular ring having an outer diameter adapted to the inner diameter of the compressed air distribution cylinder.

It is preferred to form the rotary distributor so that it passes by a lateral surface section of a cylinder about the axis of rotation, which rotary distributor slides with rotation and, conclusively, along the lateral surfaces of the compressed air distribution cylinder.

The round jet opening, the wide jet opening, and/or the compressed air feed line opening can preferably open into the lateral surface of the compressed air distribution cylinder, and the round jet setting area, the wide jet setting area, or the compressed air feed line setting area can be rotated along the lateral surface of the compressed air distribution cylinder. Alternatively or additionally, the round jet opening, the wide jet opening, and/or the compressed air feed line opening can also open in the bottom of the compressed air distribution cylinder, wherein the respective setting area can then be provided.

In order to enable a simple display of the rotary distributor setting in the compressed air distribution chamber, a setting display can be provided on the rotary handle for displaying the setting of the rotary distributor in the compressed air distribution chamber.

A compressed air distribution insert mentioned in the introduction is characterized according to the invention by the fact that, on an end of the distribution spindle, which can be inserted into the compressed air distribution chamber, a rotary distributor can be provided, which is not movable with respect to the rotary handle in the axial direction of the axis of rotation, and which is rotatable about the axis of rotation.

BRIEF DESCRIPTION OF THE FIGURES

Additional features and advantages of the invention result from the following description of a preferred embodiment example in reference to the accompanying drawings. The drawings show.

Figure 1:
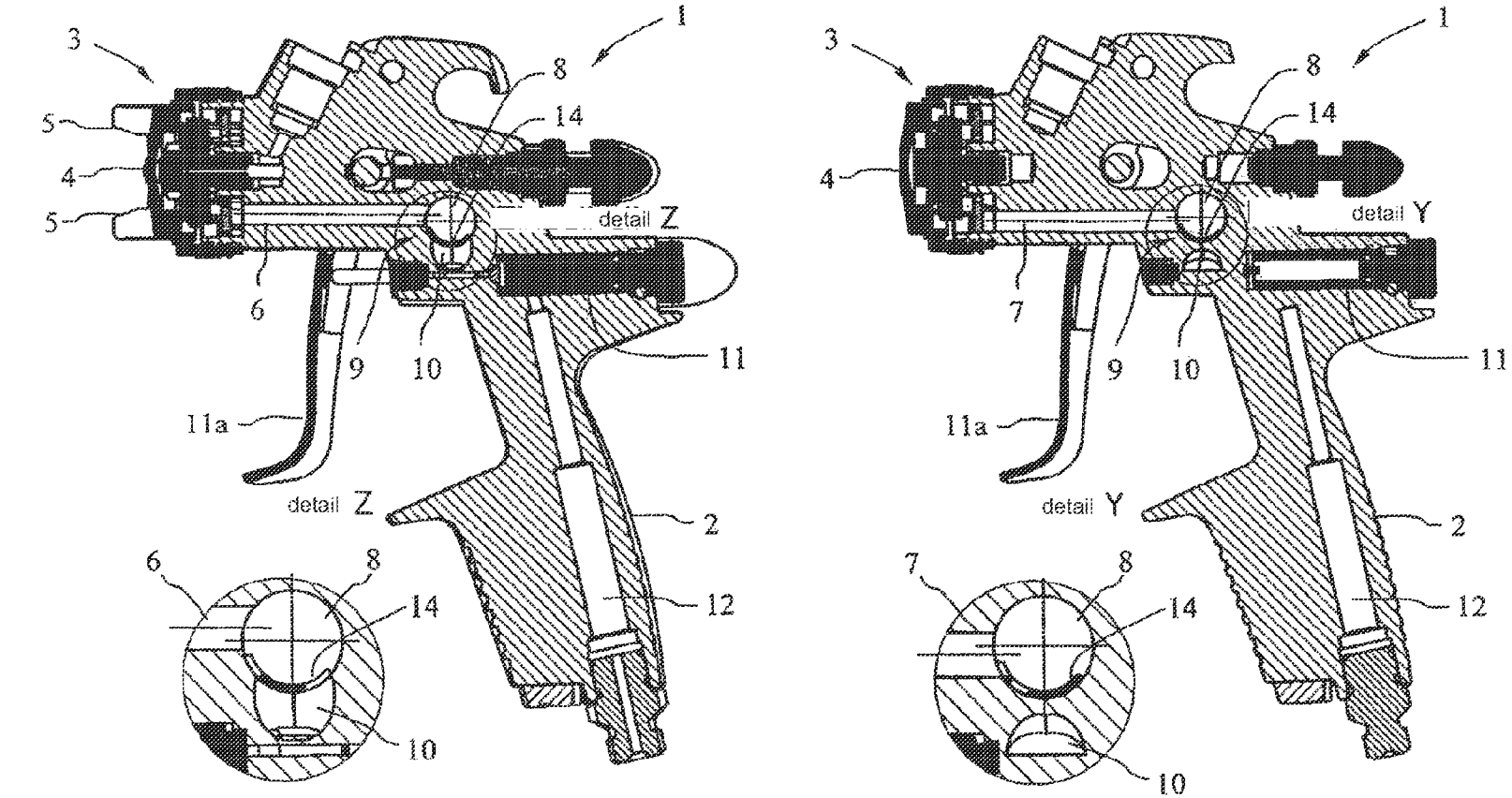
FIG. 1, two cross-sectional views through a paint spray gun according to the invention with completely opened round and wide jet lines along a a) round jet line with detail Z.
Figure 2:
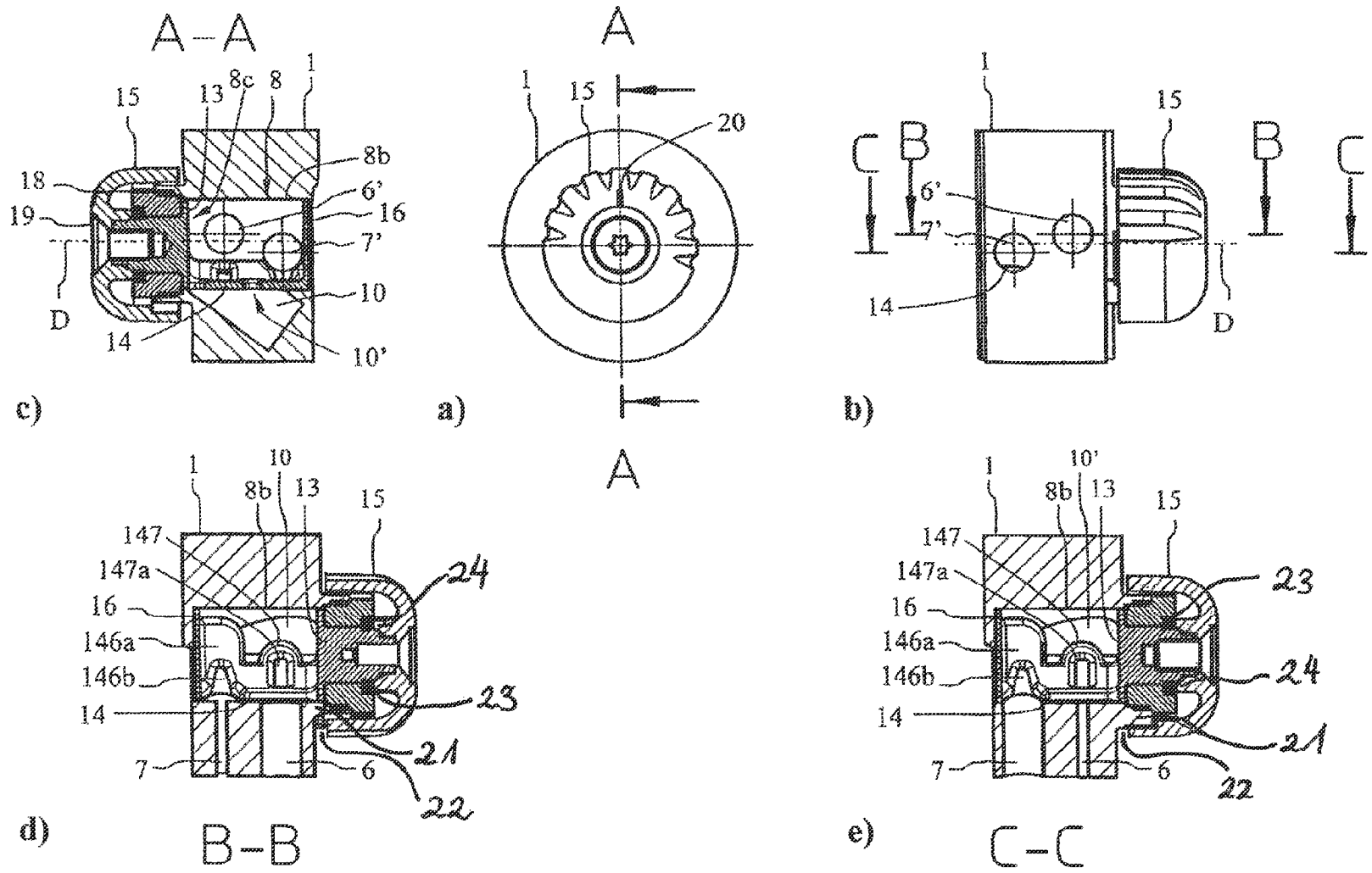
Figure 3:
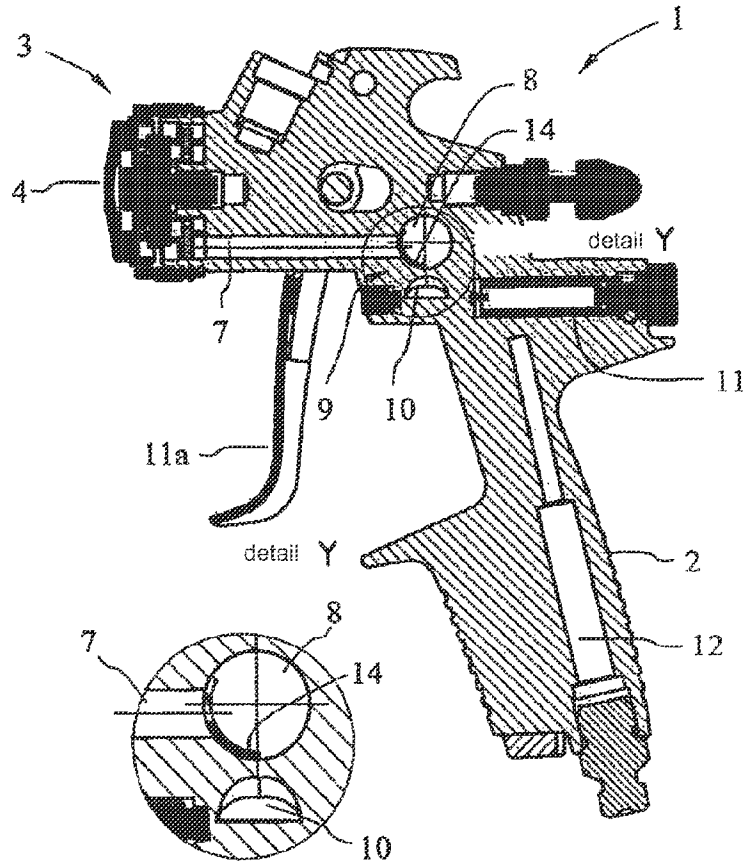
Figure 4:
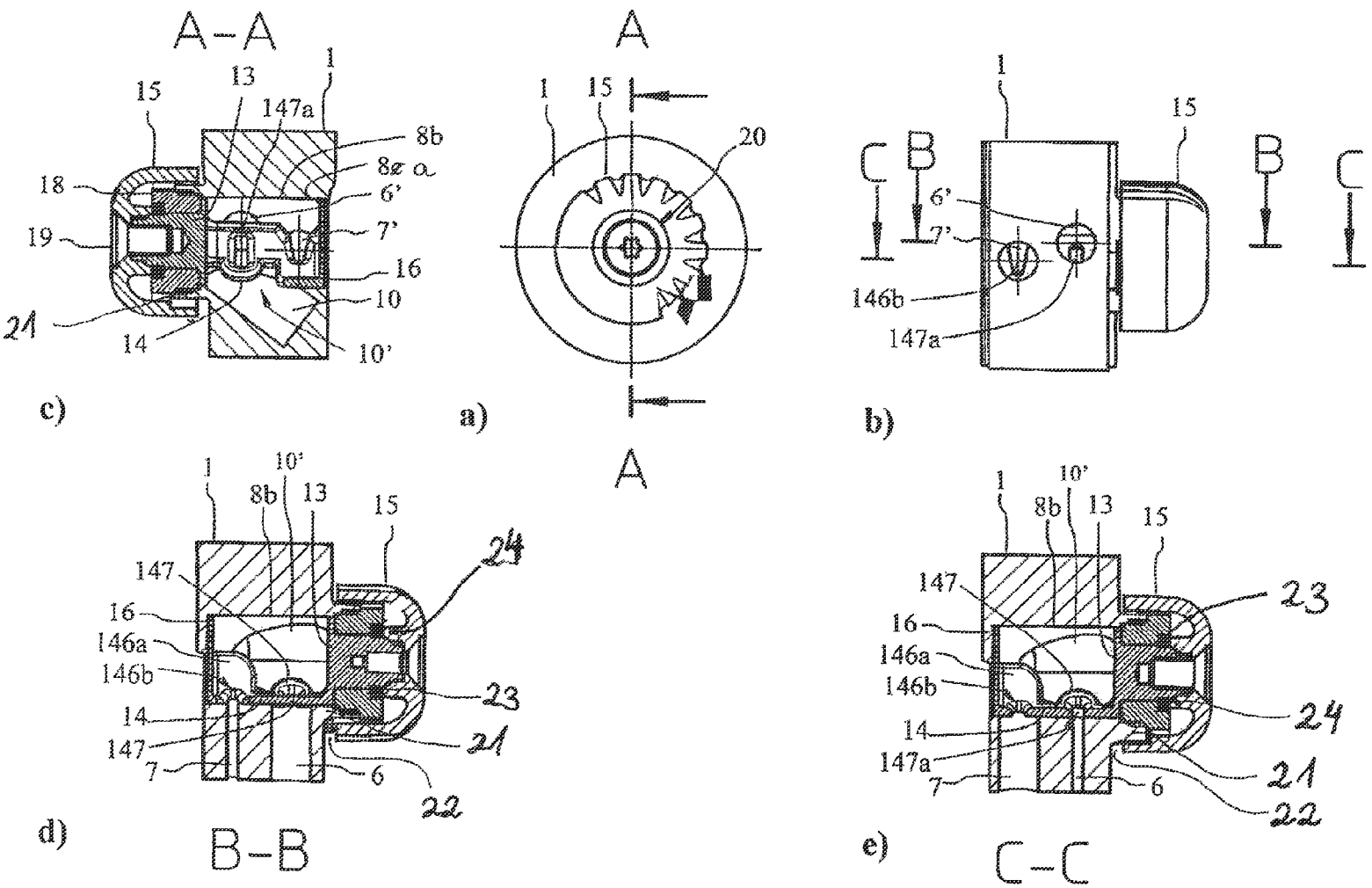
Figure 5:
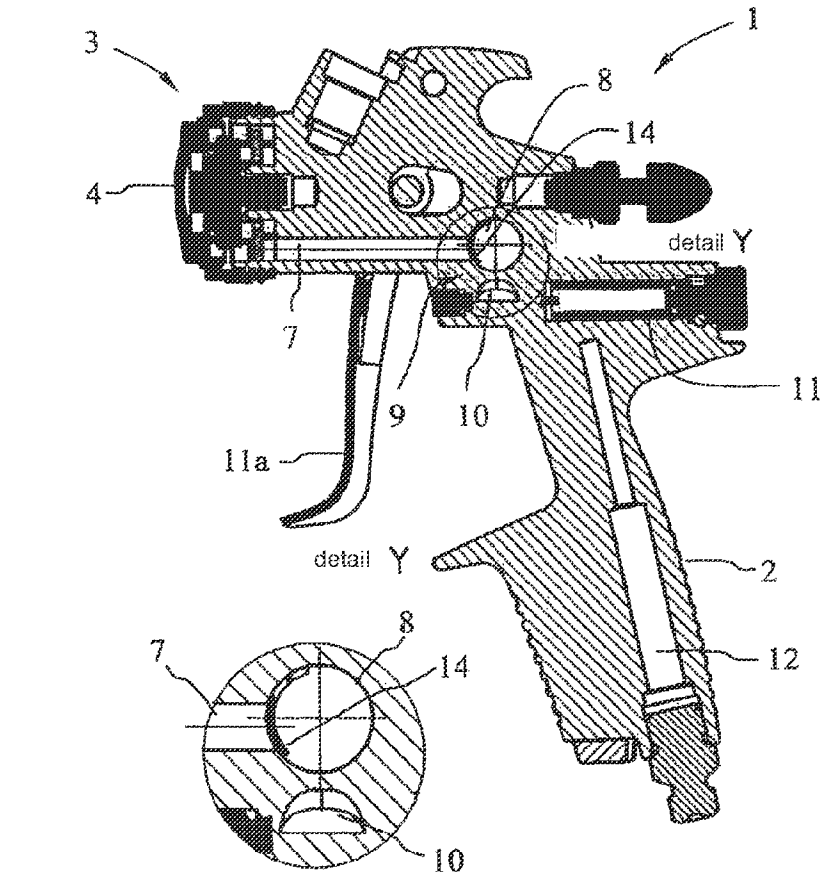
Figure 6:
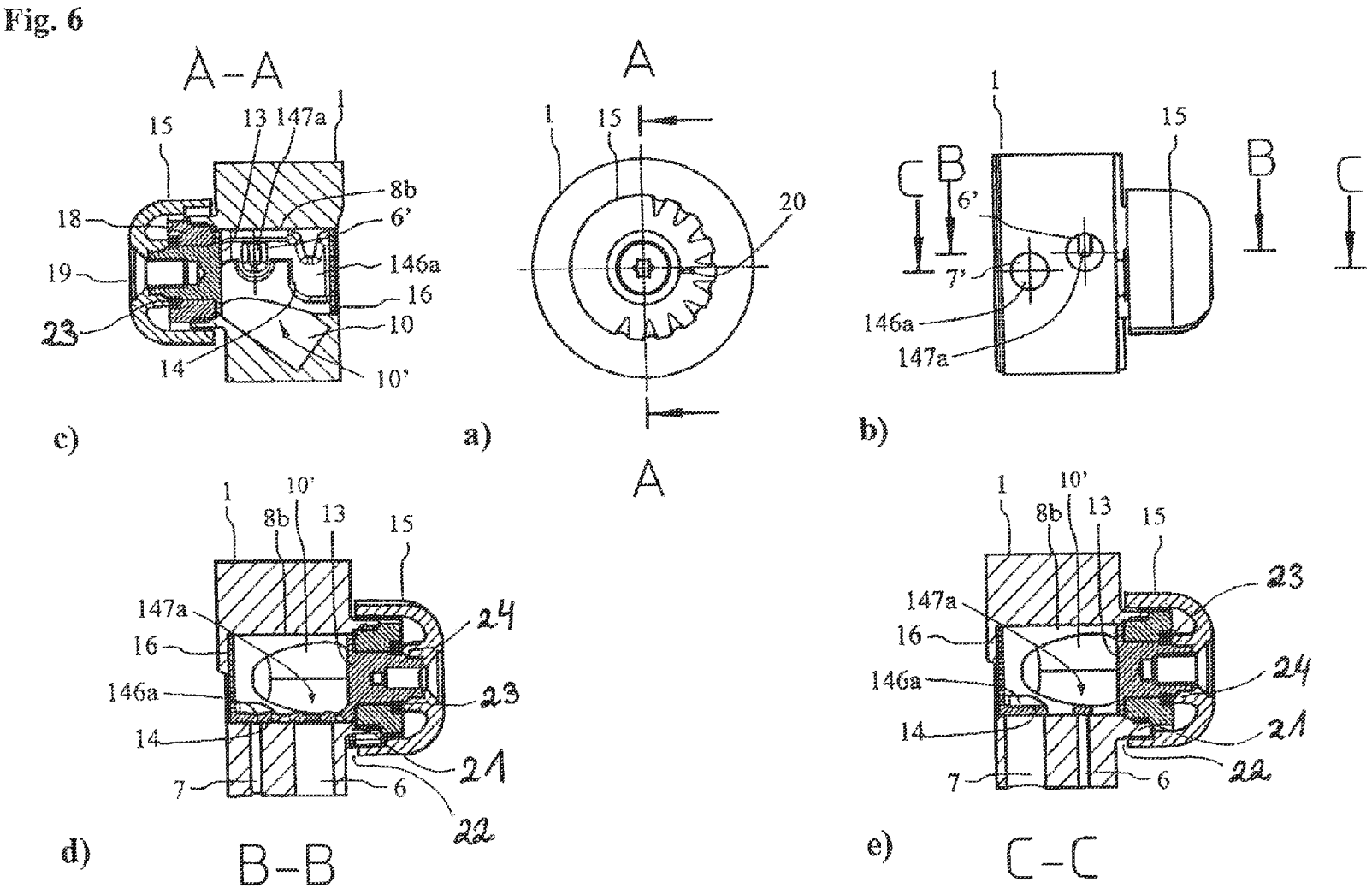
Figure 8:
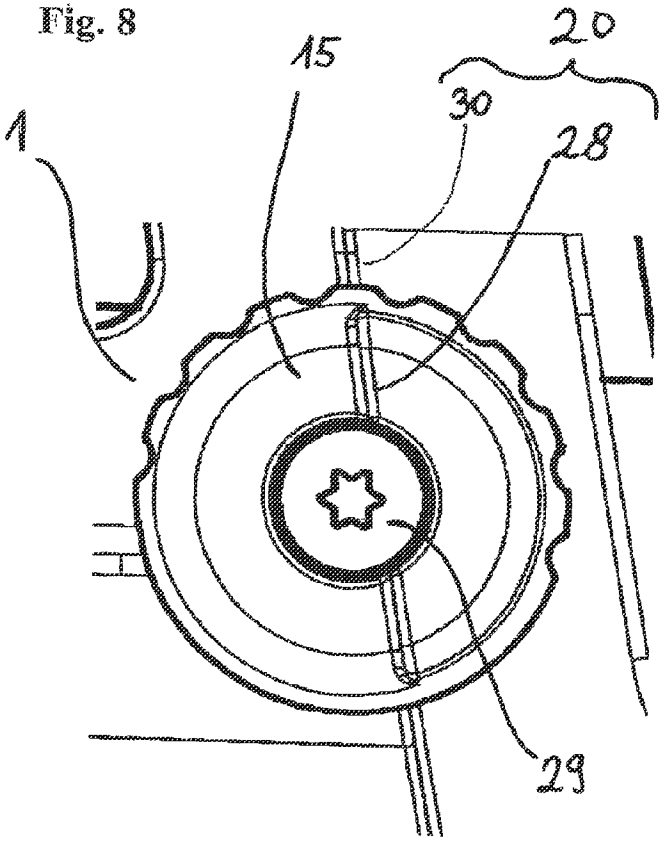
Figure 7:
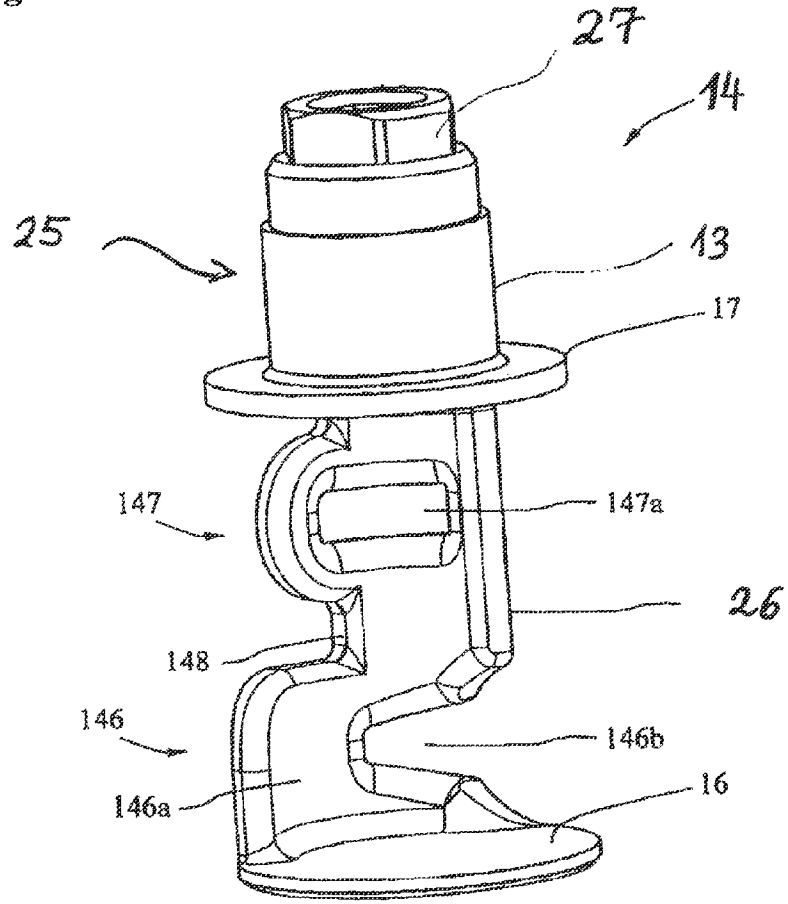

b) wide jet line with detail Y;

FIG. 2, several views of a compressed air distributor with completely opened round and wide jet lines, namely a) a front top view on the knurled knob of the compressed air distributor;

b) a side top view of the compressed air distributor of FIG. 2*a* from the left;

c) a section through the compressed air distributor of FIG. 2*a* along the line A-A;

d) a section through the compressed air distributor of FIG. 2*b* along the line B-B;

e) a section through the compressed air distributor of FIG. 2*b* along the line C-C;

FIG. 3, two cross-sectional views similar to FIG. 1 with partially opened round and wide jet lines;

FIG. 4, the views of FIG. 2 with partially opened round and wide jet lines;

FIG. 5, two cross-sectional views similar to FIG. 1 with completely closed round and wide jet lines;

FIG. 6, the views of FIG. 2 with completely closed round and wide jet lines;

FIG. 7, a diagrammatic three-dimensional view of a compressed air distribution spindle, and FIG. 8, a frontal top view on another knurled knob of the compressed air distributor.

DETAILED DESCRIPTION OF THE INVENTION

FIG. 1*a* shows a section through a paint spray gun 1 with a handle 2 and a paint nozzle head 3. The paint nozzle head 3 presents a central round jet nozzle 4 as well as two wide jet nozzles 5 arranged on horns. The round jet nozzle 4 is supplied via a round jet line 6 shown in FIG. 1*a* with compressed air, while the wide jet nozzles 5 are supplied with compressed air via a wide jet line 7 shown in FIG. 1*b*. This design of the paint spray gun 1 itself is known. The round jet line 6, as well as the wide jet line 7, open at their ends turned away from the paint nozzle head 3, with a round jet line opening 6' or wide jet line opening 7', into a compressed air distribution chamber—designed as a compressed air distribution cylinder 8—of a compressed air distributor 9.

The compressed air distribution cylinder 8 is exposed to compressed air via a compressed air feed line opening 10' of a compressed air feed line 10 and via a valve device 11, which in itself is known, from the compressed air feed 12. The valve device 11 is operated in a known manner by means of a drain-off 11*a*, so that, via the compressed air feed 12, from a not-shown compressed air source, for example, a compressor, compressed air can be introduced into the compressed air distribution cylinder 8.

In FIG. 1*a*, the section extends through the paint spray gun through the round jet line 6, while in FIG. 1*b* it extends through the wide jet line 7. As shown particularly in the detail Z or Y, the round jet line 6 is located, from the point of view of the observer of FIG. 1, before and in the paint spray gun 1 above the wide jet line 7.

The paint spray gun 1 according to the invention differs from the usual paint spray guns primarily by the compressed air distributor 9 according to the invention, which is described in detail in reference to FIGS. 2 and 7. FIG. 2*a* shows a top view on the pressure distributor 9 of FIG. 1. FIG. 2*b* shows a side view of a detail of the paint spray gun on the left of FIG. 2*a*, with easily recognizable round jet line 6 and wide jet line 7. FIG. 2*c* shows a section along the line A-A in FIG. 2*a*, FIG. 2*d* a section along the line B-B in FIG. 2*b*, and FIG. 2*e* a section along line C-C in FIG. 2*b*.

In order to be able to set the compressed air distribution in the compressed air distribution cylinder 8, as well as the pressure in the round jet line 6 and wide jet line 7, a radially adjustable distribution spindle 13 with a rotary distributor 14, as shown in FIG. 7, is inserted into the compressed air distribution cylinder 8.

The distribution spindle 13 and thus the rotary distributor 14 can be turned by means of a rotary handle designed as a knurled knob 15, which functions as handle, radially about the axis of rotation D in the compressed air distribution cylinder 8. The knurled knob 15 can be turned clockwise from the position shown in FIG. 2*a* with open wide jet line opening 7', through the position, shown in FIG. 4*a*, with partially open wide jet line opening 7', into the position, shown in FIG. 6*a*, with closed wide jet line opening 7'. As a result, the supply of compressed air to the wide jet nozzles 5 is decreased gradually at the horns of the paint nozzle head 3 until the pressure is off. A turning of the knurled knob 15 clockwise beyond the position shown in FIG. 6*a*, or counterclockwise beyond the position shown in FIG. 2*a*, is prevented by abutments 21, which in the present embodiment example are formed integrally with the spray gun body 1 (see FIGS. 2*d*, 4*d*, 6*d* as well as 2*e*, 4*e* and 6*e*). As a result, one ensures that, particularly in the completely closed wide jet line opening 7' shown in FIG. 6*a*, compressed air is not again led into the wide jet line 7 due to accidental continuation of the clockwise turning, and the minimum quantity or reduced air quantity in the round jet line 6 is not increased or not further decreased.

The knurled knob 15 is here always at the same distance 22 from the piston body 1. The distance is selected in such a manner that a penetration of overspray or the like to the distribution spindle 13 cannot occur. In the embodiment example, it is approximately 1.2 mm. The design according to the invention thus has a high operational reliability. In addition, possible irritation due to a handle being in a high position are avoided.

In FIG. 2*c*, the range of the paint spray gun 1 can be seen, in which the compressed air distribution cylinder 8 is introduced in the form of a cylindrical bore. The bottom 8*a* of the bore is planar, and forms an angle of roughly 90° with the lateral surface 8*b* of the compressed air distribution cylinder 8. Bottom 8*a* and lateral surface 8*b* form the walls of the compressed air distribution cylinder 8. From below, in reference to FIG. 2*c*, the bore of the compressed air feed line 10 can be seen, while the round jet line 6 and the wide jet line 7 open into the compressed air distribution cylinder 8, offset by roughly 90° in the peripheral direction of the compressed air distribution cylinder 8 towards the compressed feed line 10. The rotary distributor 14 can be inserted from an opening 8*c* of the compressed air distribution cylinder 8 into the latter.

The rotary distributor 14 presents, at its lower end in FIG. 7 and at the right end in FIG. 2*c*, a circular bottom disk 16. On the opposite end of the rotary distributor 14, the distribution spindle 13 presents a circular cover plate 17 which largely seals the inner space of the compressed air distribution cylinder 8 with respect to the exterior. Both the bottom disk 16 and also the cover plate 17 serve as a swivel guide of the rotary distributor 14 in the compressed air distribution cylinder 8, and ensure an application by pressure of the rotary distributor 14 on the lateral inner surface of the compressed air distribution cylinder 8. For this purpose, the bottom disk 16, as well as the cover plate 17, are adapted to the inner diameter of the compressed air distribution cylinder 8 in a manner such that an exact centric rotation is possible without large clearance, and simultaneously a good application by pressure of the rotary distributor 14 on the lateral inner surface is ensured, in order to enable a defined covering of the round jet line opening 6', the wide jet line opening 7', and the compressed air feed line opening 10'.

In the present embodiment example, the rotary distributor 14 is designed in two parts. In its area 25, shown at the top in FIG. 7, which area extends from the threading 27 to the cover plate 17 inclusive, the rotary distributor 14 is made of metal, namely brass. As a result, particularly high material strength and also precise guidance is ensured. The lower area 26, on the other hand, which extends to the bottom disk 16 inclusive, is made of plastic, namely polyamide. It is manufactured so that it is very slightly larger in terms of width, so that it is slightly squeezed after insertion into the spray gun 1. This ensures an excellent sealing guidance. In addition, in spite of the relatively complicated construction, due to the indicated material selection, it can be manufactured without problem by injection molding. Because of the combination of materials selected, the manufacturing costs of the rotary distributor 14 can consequently be kept within the desired limits.

Naturally, manufacturing the rotary distributor 14, as a single part or as several parts, from any other material or any other plastic or any other desired material combination is also possible.

At its top end, the distribution spindle 13 is rotatably mounted by means of a threaded sleeve 18 in the compressed air distribution cylinder 8, so that the rotary distributor 14, although being rotatable in the compressed air distribution cylinder 8 about the axis of rotation D, is not shiftable in the axial direction of the axis of rotation D in the compressed air distribution cylinder 8. The threaded sleeve 18 for this purpose is screwed by means of an outer threading into a corresponding inner threading at the outer end of the compressed air distribution cylinder 8. The circular area of the cover plate 17, which is turned away from the rotary distributor 14, serves as an abutment for a front side of the threaded sleeve 18, which faces the compressed air distribution cylinder 8. The threaded sleeve 18 thus ensures a secure seat of the distribution spindle 13, and consequently of the rotary distributor in the compressed air distribution cylinder 8, and, in collaboration with a gasket seal 23 having an annular design here, in addition to the cover plate 17, it seals the inner space of the compressed air distribution cylinder 8 against air flowing outwards.

In addition, the threaded sleeve 18 is sealed with respect to the gun body 1.

The knurled knob 15 is rotatably connected via a threaded screw 19 shown in FIG. 2*c* to the distribution spindle 13. The threaded screw 19 for this purpose engages in the head end of the rotary distributor 14, which is provided with a threading 27. Through the inner collar 24 on the knurled knob 15, the gasket seal 23 is prestressed at the time of the tightening of the threaded screw 19 in order to achieve a reliable seal.

The inner collar 24 on the knurled knob 15 works in collaboration with the abutments 21 on the piston body 1. In the present embodiment example, in each case one abutment 21 is provided on the opening position, as well as on the closed position. In the present embodiment example, the two positions enclose an angle of 95°. As a result, the adjustment can be visually perceived very well.

In other conceivable embodiments, larger angles, for example, 90°-180°, but preferably always smaller than 360°, can be provided.

As can be seen in FIG. 2*a*, the knurled knob 15 presents a setting display 20 in the form of a notch which points perpendicularly upwards in the case of the completely open wide jet line opening 7' shown in FIG. 2, while, in the case of completely closed wide jet line opening 7', the setting display 20 is rotated by approximately 95° clockwise in the position shown in FIG. 6*a*.

Alternatively, instead of the notch, an imprinted single marking or a scale, for example, can be provided as setting display 20. Obviously, the setting display 20 could be provided on the gun body 1 instead of the knurled knob 15.

In the variant of the knurled knob 15 shown in FIG. 8, the setting display 20 is designed in a raised position-marking 28 formed on the knurled knob 15. The position-marking 28 in this embodiment example is designed to be particularly long, and it extends to the side of the imaginary diameter line over the entire surface of the knurled knob 15, with the exception of the middle area 29 of the latter. On the gun body 1, a raised position marking 30, adjusted to the position marking 28, is provided. In this variant, the adjustment can be perceived visually particularly well.

The construction of the distribution spindle 13 and of the rotary distributor 14 is now explained in reference to FIG. 7. Due to the opening of the wide jet opening 7 in the lower bottom area of the compressed air distribution cylinder 8, a wide jet setting area 146 of the rotary distributor 14 is arranged adjacent to the bottom disk 16. The wide jet setting area 146 presents a wide jet closing area 146*a* for the complete closing of the round jet line opening 7' as well as a wide jet opening area 146*b* for the successive release or closing of the wide jet line opening 7'.

In contrast to the above, a round jet setting area 147 is located above the wide jet setting area 146 and in the vicinity of the cover plate 17, since the round jet line 6 opens into the upper area of the compressed air distribution cylinder 8. Since the round jet line opening 6' is also slightly offset in the peripheral direction of the compressed air distribution cylinder 8 towards the wide jet line opening 7', the wide jet setting area 147 is additionally offset accordingly in the peripheral direction with respect to the wide jet setting area 146. The wide jet setting area 147 presents an approximately rectangular round jet setting opening 147*a*, in the present embodiment example, which is offset with respect to the wide jet closing area 146*a* in such a manner that, when the wide jet line 7 is completely closed, and simultaneously the compressed air feed line 10 is completely opened, the permissible maximum pressure in the round jet line 6 and thus on the round jet nozzle 4 is not exceeded.

Obviously, the round jet setting area 147 can also be designed as an elongated hole or the like.

The left margin of the rotary distributor 14, in FIG. 7, the round jet setting opening 147*a*, and also the wide jet closing area 146*a* form a compressed air feed line setting area and are designed in such a manner that, in the position of the rotary distributor 14 shown in FIG. 6, the compressed air feed line opening 10' is opened completely towards the compressed air distributor 8, and covered by none of the just-mentioned components of the rotary distributor 14.

In the state shown in FIG. 2, on the other hand, both the wide jet closing area 146*a* and also the round jet setting area 147, on the left in FIG. 7, as well as the short area 148 located between them, extend so far into the compressed air feed line opening 10' that, when the round jet line opening 6' and the wide jet line opening 7' are completely open, the maximum pressure in the round jet line 6 or the wide jet line 7 does not exceed the maximum permissible pressure.

FIGS. 1 and 2 show the position of the rotary distributor 14 when the round jet line opening 6' and wide jet line opening 7' are completely open, i.e., maximum pressure on the round jet nozzle 4 and the wide jet nozzles 5. The rotary distributor 14 here completely opens the round jet line opening 6' and wide jet line opening 7' in the compressed distributor cylinder 8. The compressed air feed line opening 10', on the other hand, is covered maximally by the compressed air feed line setting area of the rotary distributor 14, in order to limit the pressure in the compressed air distribution cylinder 8 to the maximum permissible pressure.

To reduce the feed of compressed air to the wide jet nozzle 5, and thus reduce the pressure on the wide jet line opening 7' in the compressed air distribution cylinder 8, the knurled knob 15 is turned from the position shown in FIG. 2*a* clockwise by approximately 45° in the direction of the position shown in FIG. 4*a*. The user can see this immediately on the setting display 20. As a result, the wide jet opening area 146*b* of the wide jet setting area 146, which is shown in FIG. 7, is turned with its converging narrowing side flanks over the wide jet line opening 7'. At the same time, the round jet setting area 147 is turned over the round jet line opening 6', which as a result is partially covered by the front edge of the round jet setting area 147, which is on the right in FIG. 7, and partially uncovered by the round jet setting opening 147*a*. At the same time, due to the turning of the rotary distributor 14, the compressed air feed line opening 10' is successively uncovered, but, in the position shown in FIG. 4, it continues to be covered partially by the rotary distributor 14. Since the round jet line opening 6' and wide jet line opening 7' are reduced in terms of size simultaneously, while the inlet of compressed air through the compressed air feed line opening 10' is made larger, the pressure ratios in the compressed air distributor 9 adjust themselves in such a manner that the permissible maximum pressure on and in the round jet line 6 and also the wide jet line 7 is not exceeded.

If the knurled knob 15 and thus the rotary distributor 14 is then turned by an additional approximately 45° clockwise from the position shown in FIG. 4*a* into the position shown in FIG. 6*a*, the position with completely closed wide jet line opening 7' is reached. As one can see in FIGS. 6*c* and 6*b*, the wide jet line opening 7' is then completely closed, while the round jet line opening 6' is still exposed through a portion of the round jet setting opening 147*a* to compressed air from the now completely opened compressed air feed line opening 10' (FIG. 6*c* to *e*). By means of the rotary distributor 14 and its special implementation, that is, the conically narrowing course of the wide jet opening area 146*b*, of the round jet opening area 147*a*, of the adjoining round jet setting area 147, and of the compressed air feed line setting area, it is ensured that, throughout the entire closing process of the wide jet line opening 7', a pressure that exceeds the predetermined maximum pressure is not reached at or in the round jet opening 6, or at or in the wide jet line 7 and thus on the associated nozzles (round jet nozzle 4 and wide jet nozzles 5).

Alternatively, the round jet line opening 6' could be completely closed, by selecting an appropriate geometric shape of the round jet setting opening 147*a*.

In addition, depending on the shape of the wide jet opening area 146*b*, either an exponential, or a linear, or a degressive closure characteristic can be achieved.

The fact that, in the embodiment of the rotary distributor 14 according to the invention, the opening 10' of the compressed air feed line 10 can close, is the result of the above described constructive design of the rotary distributor 14, which is adapted congruently to the surfaces of the compressed air feed line 10. In alternative embodiments without such adaptation, the compressed air feed line 10 is accordingly not [closed] or not completely closed. There is no risk of large negative consequences for the desired function of the paint spray gun pistol. In any case, according to the invention, the possibility exists to feed the entire air quantity or reduced air quantity to the rotary distributor 14, as desired.

An essential advantage compared to the solutions known from the state of the art is that, in the present invention, the radial adjustment kinematics of the rotary distributor 14 allow a considerably smaller adjustment angle. In the solution according to EP 0 706 832 B1, the adjustment angle is, for example, approximately 410°, the knurled knob thus has to be turned there from the opened to the closed horn air opening, by more than one full rotation. This prevents, among other factors, a simple setting display of the current opening of the horn air opening. In addition, with the plug in the sealing spigot of EP 0 706 832 B1, setting of the correct ratio of the different openings in the compressed air distributor with respect to each other is exceedingly difficult, and a corresponding simulation or calculation is possible only at great expenditure. Here too, a linear adjustment kinematics is not possible, and the knurling knob changes its distance from the body. If it is in an undesirable high position, it is possible, under some circumstances, to introduce overspray into the gun, which is not the case in the solution according to the invention.

An additional advantage of the invention is that single-handed operation of the rotary distributor 14 is possible without a problem.

In an alternative design of the distribution spindle 13, the rotary distributor can also be designed differently. For example, as rotary distributor, a hollow cylinder can be used whose lateral surface halves, divided in the axial direction, present symmetric, mutually transitioning round jet, wide jet and compressed air feed line setting areas. As a result, the hollow cylinder could be turned with a rotation of 180° from the completely opened into the completely closed position of the wide jet line opening 7', wherein, due to the subsequent further rotation in the same direction, the wide jet line opening 7' could then be opened again in a corresponding manner. Instead of a division into halves, the hollow cylinder can also be divided into quarters, which again present corresponding symmetric and mutually transitioning round jet, wide jet, and compressed air feed line setting areas. Then, by means of a rotation of 90°, one can alternate between the opened and closed position of the wide jet line opening 7', namely a total of four times within one full rotation of the hollow cylinder. Said alternatives present the advantage that no abutments are needed to prevent overrotation of the distributor spindle in any direction. If the round jet, wide jet, and compressed air feed line setting areas in the alternatives are mutually transitioning, but not mutually symmetrical in design, then different characteristics of the compressed air distribution could be enabled between the opened and closed position of the wide jet line opening.

In an additional alternative, instead of the rotary distributor 14, a solid cylinder can also be used, which presents an inlet opening that serves to partially open or close the compressed air feed line 10, wherein, from this inlet opening, two channels then branch off in the solid cylinder to the wide jet line opening 7' or the round jet line opening 6'. The channels then present, at their other end, openings in the solid cylinder which are designed in such a manner in reference to the wide jet line opening 7' or round jet line opening 6', that, when the wide jet line opening 7' is completely closed, the allowed maximum pressure still is applied on the round jet line opening 6'. Similarly, all the openings in the solid cylinder are designed in such a manner that, during the closing process, the maximum pressure is exceeded at no point at or in the round jet line 6 or the wide jet line 7.

In an additional embodiment, the round jet line opening 6', the wide jet line opening 7' or the compressed air feed line opening 10' or also several of these openings can open at the bottom of the compressed air distribution cylinder 8. To be able to close or open said openings arranged in the bottom, the corresponding setting area then has to be provided with opening and closing areas in the bottom disk 16 of the distribution spindle 13. For example, if the wide jet line opening is in an eccentric position in the bottom of the compressed air distribution cylinder 8, that is outside of its central longitudinal axis, then it would be advantageous if, in the bottom disk 16, a wide jet line opening adapted to the size of the wide jet line opening would narrow in a spiral pattern to a wide jet closing area without opening.

In an additional embodiment, the compressed air distribution chamber can present, instead of a continuous compressed air distribution cylinder 8 with one diameter, preferably also mutually axially arranged cylinder bores of different diameter, where the diameter preferably decreases stepwise from the opening of the compressed air distribution chamber to the bottom. The distributor device is then advantageously adapted to the change in diameter. Instead of a step-shaped change in the diameter of the compressed air distribution chamber, the compressed air distribution chamber can also be designed advantageously in a conical shape or present a conical area, wherein the distributor device is then also adapted advantageously to this shape of the compressed air distribution chamber.

In order to make the advantages of the invention available for an already existing paint spray gun, the compressed air distribution insert can be formed from the distribution spindle 13 with the rotary distributor 14, the threading sheath 18, the knurled knob 15, and the threaded screw 19. Said compressed air distribution insert can then be inserted in the compressed air distribution chamber of the existing paint spray gun. Here, the shape of the compressed air distribution chamber can be taken into account advantageously in the design and modeling of the rotary distributor. Similarly, the other components of the compressed air distribution insert are adapted to the circumstances of the existing paint spray gun. Due to the simple design of the rotary distributor, the determination of its shape and the resulting compressed air distribution in the compressed air distribution chamber can be determined in a simple manner from the shape of the existing compressed air distribution chamber. The additional advantages and designs of the individual components of the compressed air distribution insert, which are indicated extensively above in the description of the pain spray gun according to the invention, naturally also apply to the compressed air distributor inset itself. Instead of the knurled knob, any other suitable rotating handle can be attached to the distribution spindle.

Other alternative embodiments, in which the mouths of the round jet line 6, of the wide jet line 7, as well as of the compressed air feed line 10 into the compressed air distribution cylinder 8 can be adjusted exclusively by turning about the axis of rotation D, without actual shift of rotary distributors, perforated aperture plates, etc., are also within the scope of the present invention.

| List of references | |
|---|---|
| 1 | Paint spray gun |
| 2 | Handle |
| 3 | Paint nozzle head |
| 4 | Round jet nozzle |
| 5 | Wide jet nozzle |
| 6 | Round jet line |
| 6' | Round jet line opening |
| 7 | Wide jet line |
| 7' | Wide jet line opening |
| 8 | Compressed air distribution cylinder |
| 8a | Bottom |
| 8b | Lateral surface |
| 8c | Opening |
| 9 | Compressed air distributor |
| 10 | Compressed air feed line |
| 10' | Compressed air feed line opening |
| 11 | Valve device |
| 11a | Draw-off |
| 12 | Compressed air feed |
| 13 | Distribution spindle |
| 14 | Rotary distributor |
| 15 | Knurling knob |
| 16 | Bottom disk |
| 17 | Cover plate |
| 18 | Threaded sleeve |
| 19 | Threaded screw |
| 20 | Setting display |
| 21 | Abutment |
| 22 | Distance |
| 23 | Gasket seal |
| 24 | Collar |
| 25 | Upper area of 14 |
| 26 | Lower area of 14 |
| 27 | Threading |
| 28 | Position marking |
| 29 | Middle area |
| 30 | Marking |
| 146 | Wide jet setting area |
| 146a | Wide jet closing area |
| 146b | Wide jet opening area |
| 147 | Round jet setting area |
| 147a | Round jet setting opening |
| 148 | Short area |

The invention claimed is:

1. A paint spray gun comprising:

a compressed air distribution chamber;

a compressed air feed line, a round jet line, and a wide jet line, all of which open into the compressed air distribution chamber;

an actuating element external to the compressed air distribution chamber and rotatable about a control axis of rotation extending through the compressed air distribution chamber; and a spindle rotatable in connection with the actuating element, movement of the spindle radially rotatable about the control axis and not axially movable along the control axis, the spindle including:

a sealing surface pressed against an inside surface of the air distribution chamber, first and second portions of the sealing surface forming first and second ports, respectively, the first port radially slidable past and over only the round jet line opening, the second port radially slidable past and over only the wide jet line opening, as the spindle is radially rotated, the first and second ports which are elongated in a radially extending direction and are shaped and positioned to simultaneously and independently, with respect to each other, partially block the round jet line and wide jet line openings to a predetermined extent, independently relative to each other, at a given angle of rotation of the spindle.

2. The paint spray gun according to 1, wherein the compressed air distribution chamber is a cylinder shape, is bounded by a lateral surface, has an open end, and a closed end, and the compressed air feed line introduces compressed air into the compressed air distribution chamber along the lateral surface.

3. The paint spray gun according to claim 2, wherein the spindle includes a circular guide having an outer diameter equal to an inner diameter of the compressed air distribution cylinder.

4. The paint spray gun according to 2, wherein the round jet line, the wide jet line, and the compressed air feed line open into the compressed air distribution chamber at the lateral surface.

5. The paint spray gun according to claim 1, wherein the spindle is formed as a section of a cylinder about an axis of rotation that is coaxial with the actuating element.

6. The paint spray gun according to claim 1, wherein shapes of at least one the ports of the first and second portions define an opening shape that is elongated along a radial direction relative to the control axis and has non-uniform width along the radial direction.

7. The paint spray gun according to claim 1, wherein the spindle further comprises a third sealing surface portion for controlling communication with the compressed air feed line, the third portion radially extending along the sealing surface, shaped to block and expose predetermined amounts of the compressed air feed opening at a given angle of rotation of the spindle, to thereby control an amount of air that is admitted from compressed air feed at the given angle of rotation of the spindle.

8. The paint spray gun according to claim 1, further comprising at least one setting display for displaying a radial orientation of the spindle in the compressed air distribution chamber.

9. The paint spray gun according to claim 8, wherein the setting display is a marking on each of the actuating element and a body of the paint spray gun.

10. The paint spray gun according to claim 8, wherein the marking is in a form of a raised position marking.

11. The paint spray gun according to claim 1, wherein the spindle contacts at least one abutment on a body of the paint spray gun to limit rotation of the spindle.

12. The paint spray gun according to claim 11, wherein the at least one abutment includes two cooperating abutments which determine at least opening and closing rotational positions of the spindle.

13. The paint spray gun according to claim 12, wherein the spindle rotates through an angle of approximately 95° between the opening and closing positions.

14. A paint spray gun comprising:

a compressed air distribution chamber defining an interior surface and a longitudinal central axis;

a compressed air feed line, a round jet line, and a wide jet line, all of which open into the compressed air distribution chamber;

an actuating element external to the compressed air distribution chamber and rotatable about a control axis of rotation extending through the compressed air distribution chamber; and a spindle rotatable in connection with the actuating element, movement of the spindle confined to a radial rotation about the control axis, the spindle including:

a sealing surface pressed against an inside surface of the air distribution chamber, first and second portions of the sealing surface forming first and second ports, respectively, the first port radially slidable past and over the round jet line opening, the second port radially slidable past and over the wide jet line opening, as the spindle is radially rotated;

the first and second ports disposed at different axial displacements along the longitudinal axis to thereby not overlap each other in the axial direction, each radially extending along the sealing surface, each forming a radially extending elongate opening shaped to simultaneously partially block the respective round jet line and wide jet line opening to a predetermined extent independently relative to a position of the other port, to thereby control an amount of air that is admitted into the round jet line and wide jet line, respectively.

15. The spray gun of claim 14, wherein the spindle includes a resilient material which is squeezed against the interior surface of the air distribution chamber to form an air seal.

16. The spray gun of claim 14, wherein the actuator is composed of metal and the spindle is composed of plastic.

17. The spray gun of claim 14, wherein the spindle is fabricated with polyamide.

18. The spray gun of claim 14, wherein at least one of the first and second portions are shaped to progressively block a respective opening as the spindle is rotated.

19. The spray gun of claim 14, further including a third portion radially extending along the sealing surface and shaped to block the compressed air line to a predetermined extent at a given angle of rotation of the spindle, to thereby control an amount of air that is admitted from the compressed air line into the air distribution chamber at the given angle of rotation of the spindle.

20. A paint spray gun comprising:

a compressed air distribution chamber defining a sealed end with an opening, a closed end, a cylindrical interior surface disposed between the sealed end and the closed end, and a longitudinal central axis;

a compressed air feed line, a round jet line, and a wide jet line, all of which open into the compressed air distribution chamber along the cylindrical interior surface;

an actuating element external to the compressed air distribution chamber and rotatable about the central axis; and a spindle inserted into the cylindrical interior surface and rotatable in connection with the actuating element, movement of the spindle confined to a radial rotation about the central axis, the spindle including:

a sealing surface squeezed against the cylindrical interior surface of the air distribution chamber, the sealing surface forming first, second, and third ports each radially slidable past and over only one of the round jet line, wide jet line, and compressed air openings, respectively, as the spindle is radially rotated the first and second ports axially separated from each other along the central axis;

the third port radially extending along the sealing surface and shaped to block the compressed air line to a predetermined extent between closed and open at a given angle of rotation of the spindle, to thereby control an amount of air that is admitted from the compressed air line into the air distribution chamber at the given angle of rotation of the spindle.

* * * * *